US009289825B2

(12) United States Patent
Terada

(10) Patent No.: US 9,289,825 B2
(45) Date of Patent: Mar. 22, 2016

(54) POURING EQUIPMENT HAVING MELTING FURNACE

(75) Inventor: Hideto Terada, Nagoya (JP)

(73) Assignees: SINTOKOGIO, LTD., Nagoya-Shi (JP); FUJIWA DENKI CO., LTD., Nagoya-Shi (JP)

( * ) Notice: Subject to any disclaimer, the term of this patent is extended or adjusted under 35 U.S.C. 154(b) by 616 days.

(21) Appl. No.: 13/501,707

(22) PCT Filed: Nov. 29, 2010

(86) PCT No.: PCT/JP2010/071269

§ 371 (c)(1),
(2), (4) Date: Jun. 26, 2012

(87) PCT Pub. No.: WO2011/086778

PCT Pub. Date: Jul. 21, 2011

(65) Prior Publication Data

US 2012/0267834 A1 Oct. 25, 2012

(30) Foreign Application Priority Data

Jan. 13, 2010 (JP) ..... 2010-004800
Sep. 15, 2010 (JP) ..... 2010-206845

(51) Int. Cl.
*B22D 41/06* (2006.01)
*B22D 41/12* (2006.01)
(Continued)

(52) U.S. Cl.
CPC ..... *B22D 41/06* (2013.01); *B22D 41/12* (2013.01); *B22D 45/00* (2013.01); *F27B 14/02* (2013.01); *F27D 3/12* (2013.01)

(58) Field of Classification Search
CPC ..... B22D 11/116; B22D 33/00; B22D 41/12; B22D 13/101; B22D 39/06; B22D 41/04; B22D 15/00; B22D 41/06; B22D 45/00; B22D 41/01; B22D 41/00; F27B 14/061; F27B 3/065; F27B 14/02; F27D 11/06; F27D 2099/0098; F27D 3/12; F27D 3/14
USPC ..... 266/240, 44, 236, 99, 96, 45; 164/335, 164/457, 155.7, 136, 336, 337; 373/143, 373/138
See application file for complete search history.

(56) References Cited

U.S. PATENT DOCUMENTS 2,586,596 A * 2/1952 Bahney ..... 373/143
3,685,573 A * 8/1972 Domres et al. ..... 164/335
(Continued)

FOREIGN PATENT DOCUMENTS

CN 101244457 8/2008
JP 08-025024 1/1996
(Continued)

OTHER PUBLICATIONS

Chinese Patent Office, Office Action issued in Chinese application 201010570742.X, Mar. 1, 2013, 2 pages.
(Continued)

*Primary Examiner* — Scott Kastler
*Assistant Examiner* — Michael Aboagye
(74) *Attorney, Agent, or Firm* — Finnegan, Henderson, Farabow, Garrett & Dunner, L.L.P.

(57) ABSTRACT

To transfer the molten metal that is melted in the melting furnace into the pouring ladle, which is a vessel for transporting the molten metal to the place for pouring, and to further lift the pouring ladle by another crane to pour the molten metal, requires time, such that the molten metal that had a high temperature when melted by the melting furnace is likely to cool down and to cause a defective cast product. To solve the problem the pouring equipment of the present invention pours the molten metal into the mold, comprising the melting furnace that produces molten metal by melting metal material and a driving apparatus that can move the melting furnace backward and forward or in a traverse direction, wherein the pouring equipment moves the melting furnace to the predetermined position by the driving apparatus, and then pours the molten metal into a mold by tilting the melting furnace relative to the mold.

5 Claims, 15 Drawing Sheets

(51) Int. Cl.

| | |
|---|---|
| ***B22D 45/00*** | (2006.01) |
| ***F27B 14/02*** | (2006.01) |
| ***F27D 3/12*** | (2006.01) |

(56) References Cited

U.S. PATENT DOCUMENTS

| | | | | |
|---|---|---|---|---|
| 4,112,998 | A * | 9/1978 | Sato | 164/136 |
| 5,271,033 | A * | 12/1993 | Bethge et al. | 373/143 |
| 5,343,492 | A * | 8/1994 | Henn | 373/143 |
| 8,327,912 | B2 | 12/2012 | Terada et al. | |
| 2008/0196856 | A1 * | 8/2008 | Terada et al. | 164/136 |

FOREIGN PATENT DOCUMENTS

| | | | | |
|---|---|---|---|---|
| JP | 08025024 | * | 1/1996 | B22D 41/06 |
| JP | 09-108823 | | 4/1997 | |
| JP | 09-174229 | | 7/1997 | |
| WO | WO 2008/099556 A1 | | 8/2008 | |

OTHER PUBLICATIONS

International Search Report dated Jan. 25, 2011 issued in International Application No. PCT/JP2010/071269.

* cited by examiner

POURING EQUIPMENT HAVING MELTING FURNACE

This invention relates to equipment that pours molten metal from a melting furnace directly into a mold in casting works.

BACKGROUND

Conventionally in casting works a cast product has been manufactured from molten metal of a high temperature that is melted in the melting furnace, which molten metal is then poured into a pouring ladle. Then the pouring ladle is transported to a place for pouring where the molten metal is poured in a mold.

RELATED ART

Patent Documents

Patent Document 1: Publication of Japanese Patent Application, Publication No. H09-174229

The place where the melting furnace is installed is separate from the place for pouring. So, the molten metal that is melted in the melting furnace is transferred into the pouring ladle, which then is transported by various transporting equipment such as a transporting carriage, forklift, crane, monorail hoist, etc., to the place for pouring where an operator usually lifts the pouring ladle by a crane or hoist and manually pours the molten metal into the mold. Recently the operators' work for pouring is often taken over by an automatic pouring machine.

SUMMARY OF INVENTION

Problem to be Solved by the Invention

However, to transfer the molten metal that is melted in the melting furnace into the pouring ladle, which is a vessel for transporting the molten metal to the place for pouring, and to further lift the pouring ladle by another crane to pour the molten metal, requires time, such that the molten metal that had a high temperature when melted by the melting furnace is likely to cool down and to cause a defective cast product. So, to minimize a lowering of the temperature a great skill is required to shorten the operating time, etc.

Also, the transport of the molten metal having a high temperature was often accompanied by smoke that was emitted from the molten metal, which smoke was likely to deteriorate the working environment. Further, there was a problem in that a spill or scattering of the molten metal having a high temperature was likely to cause fire or an explosion.

In view of these problems, the purpose of the present invention is to provide pouring equipment having a melting furnace where it is disposed at a location close to a place for pouring and where the melting furnace works as a pouring machine such that the molten metal can be poured from the melting furnace directly into a mold.

Means to Solve Problem

To achieve the above purpose the pouring equipment of the present invention pours the molten metal into the mold. The pouring equipment comprises the melting furnace that produces molten metal by melting metal material and a driving apparatus that can move the melting furnace backward and forward and in a traverse direction, wherein the pouring equipment moves the melting furnace to the predetermined position, i.e., the position that faces the mold, by the driving apparatus, and then pours the molten metal into the mold by tilting the melting furnace relative to the mold.

Effect of Invention

The pouring equipment of the present invention, by pouring the molten metal directly from the melting furnace into the mold, can reduce the lowering of the temperature of the molten metal such that it is not necessary to unnecessarily raise the temperature of the molten metal that is melted in the melting furnace, anticipating that the temperature of the molten metal would be lowered during the transport as in the conventional pouring equipment. Thus the consumption of electricity for melting the metal material is greatly reduced. Also, to control the temperature of the molten metal becomes easier, thereby reducing the number of defective products that are related to the temperature of the molten metal. Moreover, if a casting line were to stop, the melting furnace would only be kept on standby, causing no molten metal that had already been melted to be unused. The pouring equipment of the present invention need not have the molten metal transported by the pouring ladle. Thus the problem of smoke does not occur during the transport, nor does it cause any deterioration of the working environment. Also, fire or an explosion due to the spill or scattering of the molten metal of a high temperature can be reduced.

Also, the pouring equipment of the present invention can comprise a servomotor for driving the driving apparatus, a driving apparatus for tilting, such as a servomotor for tilting the melting furnace, a load cell that measures the quantity of the molten metal that is the weight of the molten metal that was poured from the melting furnace into the mold, and a control apparatus that controls, based on the quantity of the molten metal that was poured, the servomotor for driving the driving apparatus and a driving apparatus for tilting such as the servomotor for tilting the melting furnace, wherein the pouring equipment can automatically pour the molten metal into the mold under the control of the control apparatus. By the control of the control apparatus, the pouring equipment of the present invention can automatically and accurately pour the molten metal.

Also, the pouring equipment of the present invention can comprise the melting furnace that can tilt around two axes for tilting. Preferably the two axes for tilting are disposed between the upper end and the lower end of the melting furnace where a first axis extends perpendicularly to the direction of the tilting of the melting furnace and a second axis, which extends parallel to the first axis, is disposed between the first axis and an outflow portion that is provided at the upper end of the melting furnace and which second axis is disposed closer to the outflow portion. Both the first axis and the second axis extend horizontally. Preferably the second axis is disposed closer to the outflow portion. The pouring equipment thus constituted can pour the molten metal into the mold where the melting furnace is tilted by being rotated around the first axis, thereby having the outflow portion come closer to the mold just before the start of the pouring and where the melting furnace is further tilted by being rotated around the second axis so to as to pour the molten metal into the mold. Thus the outflow portion of the melting furnace can be closer to the mold such that the spilling or scattering of the molten metal can further be reduced and the pouring can be carried out more accurately.

The pouring equipment of the present invention that pours the molten metal into the mold comprises the melting furnace that produces the molten metal by melting the metal material and a control apparatus for controlling the position of the mold, which apparatus moves the mold backward and forward and to the left and right relative to the melting furnace. The pouring equipment can move the mold by the control apparatus for controlling the position of the mold to the predetermined position, namely, the position that faces the melting furnace and has the molten metal poured into the molds from the melting furnace that is being tilted relative to the mold.

The pouring equipment thus constituted need not have the melting furnace moved so as to have the outflow portion of the melting furnace match the position of the mold, thus dispensing with a mechanism to move the melting furnace. So, the pouring equipment can be compact. Also, an initial cost for investment and its running cost can be reduced.

The pouring equipment of the present invention has the melting furnace that has an outflow portion, from which the molten metal is poured into the mold, where the cross-sectional side view of the end-part of the outflow portion may have a circular arc, and where the center of the circle that comprises the circular arc can be a center for tilting the melting furnace. Preferably the center of the circle that comprises the circular arc can be identical with the second axis. If the center of the circle that comprises the circular arc is made to be identical with the second axis for tilting, the flow line of the molten metal as it flows from the outflow portion can form a stable line, thus further improving the accuracy in pouring. The cross-sectional side view of the end-part of the outflow portion refers to the cross-sectional view where the end-part of the outflow portion is cut by an imaginary vertical plane that is parallel to the direction of tilting the melting furnace.

EMBODIMENT FOR CARRYING OUT INVENTION

Figure 1:
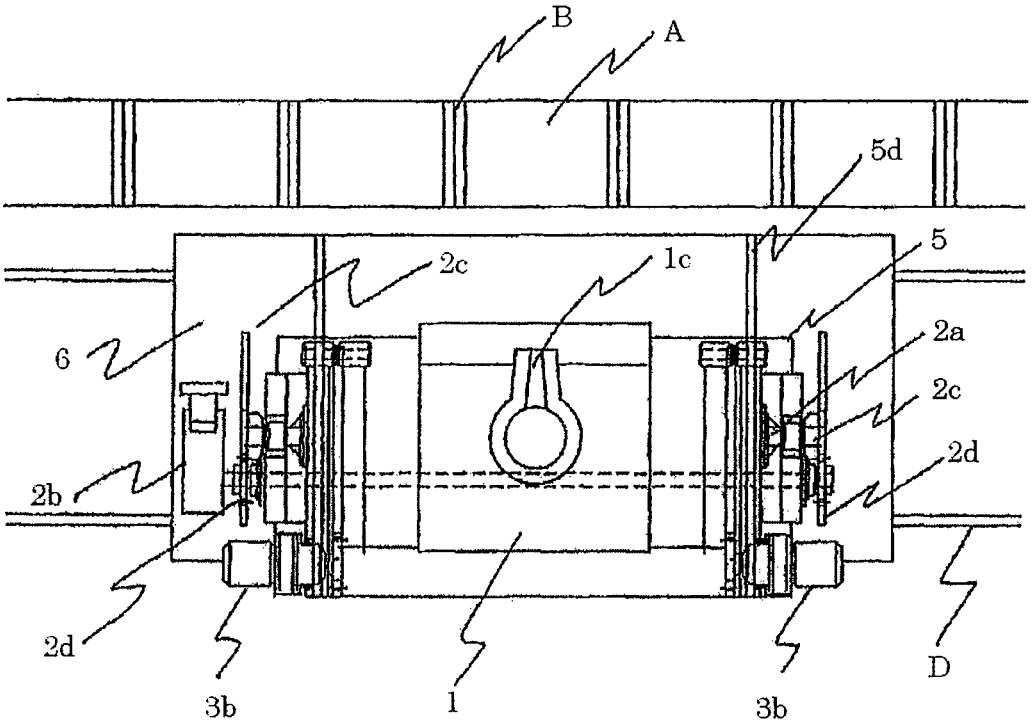
FIG. 1 is a schematic plan view of the pouring equipment having the melting furnace in the first embodiment of the present invention.

The pouring equipment having the melting furnace in the first embodiment of the present invention is now explained based on the drawings. FIG. 1 shows the first embodiment of the present invention, namely, a schematic plan view of the pouring equipment having the melting furnace.

As shown in FIG. 1, the melting furnace 1 is movable on rails D that are laid parallel to a casting line A.

Figure 2:
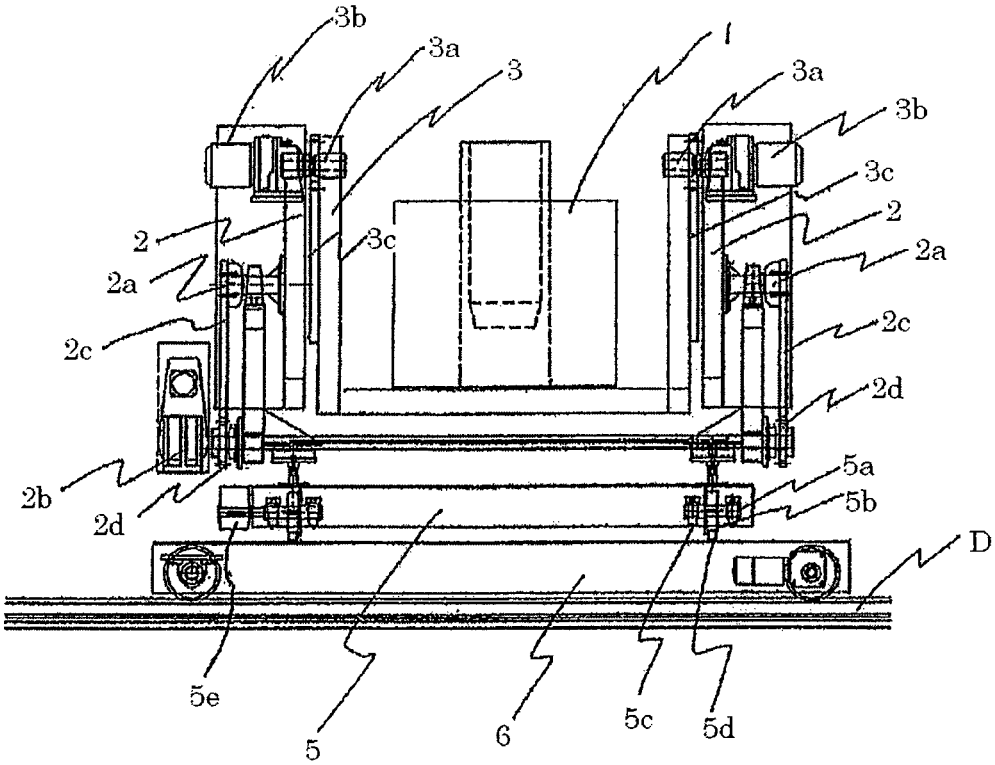
FIG. 2 is a schematic front view of the pouring equipment having the melting furnace in the first embodiment of the present invention.

FIG. 2 is a schematic front view of the pouring equipment having the melting furnace in the first embodiment of the present invention. As shown in FIG. 2, a carriage that moves in a traverse direction 6 is disposed on the rails D that are laid on a floor. The carriage that moves in a traverse direction 6 is movable on the rails D. A carriage that moves backward and forward 5 is disposed on the carriage that moves in a traverse direction 6.

A measuring frame 4 is disposed on top of the carriage that moves backward and forward 5 (see FIG. 3) and a first tilting frame 2 is supported by the first axis for tilting 2*a* and disposed above the measuring frame 4 while a second tilting frame 3 is supported by the first tilting frame 2 via the second axis for tilting 3*a*, which is at the upper end of the first tilting frame 2. The melting furnace 1 is fixed onto the second tilting frame 3. The carriage that moves in a traverse direction 6 and the carriage that moves backward and forward 5 correspond to the driving apparatus as stated in the claims.

Figure 3:
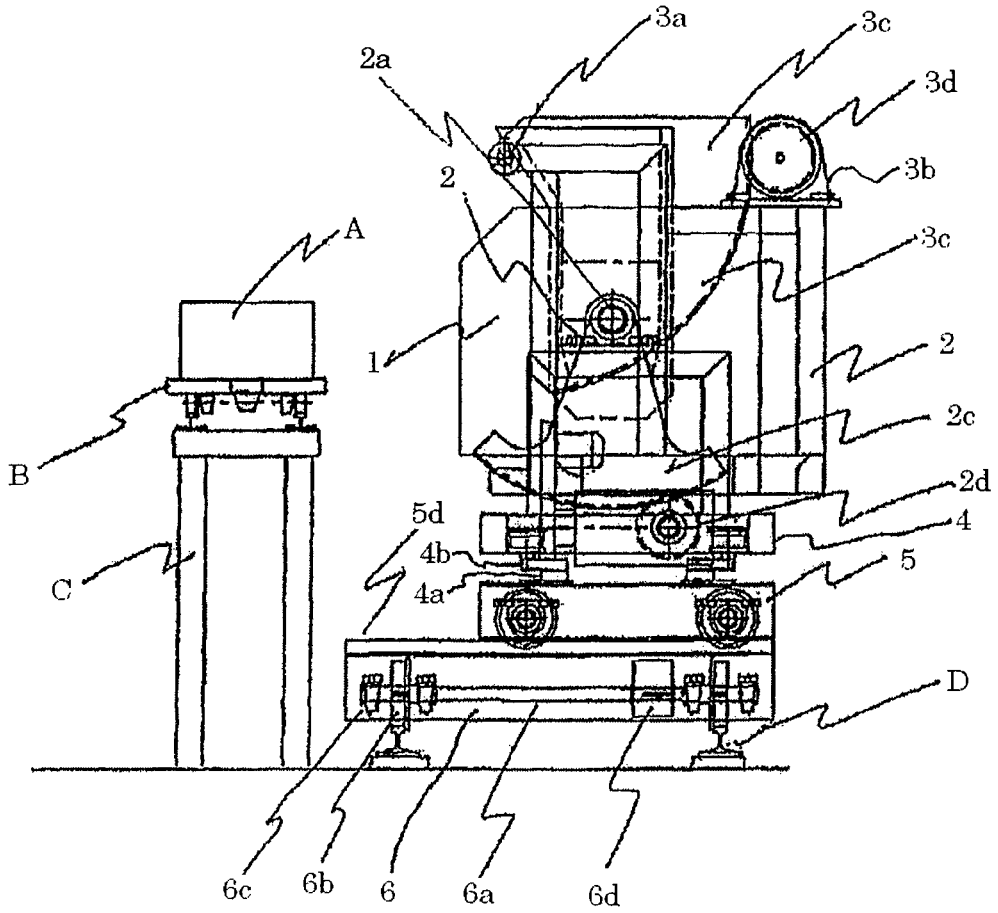
FIG. 3 is a schematic side view of the pouring equipment having the melting furnace in the first embodiment of the present invention.

FIG. 3 is a schematic side view of the pouring equipment having the melting furnace in the first embodiment of the present invention, which equipment works also as a melting furnace. As shown in FIG. 3, the carriage that moves in a traverse direction 6 is disposed on the rails D that are laid on the floor. The carriage that moves in a traverse direction 6 is driven by a servomotor for driving in a traverse direction 6*d*, and it is movable on the rails D. The carriage that moves in a traverse direction 6 is supported by running wheels 6*b*, axles 6*a*, and bearings 6*c*. As shown in FIG. 2, the carriage that moves backward and forward 5 is disposed on the rails 5*d* that are fixed onto the carriage that moves in a traverse direction 6. The carriage that moves backward and forward 5 is driven by the servomotor for driving backward and forward 5*e* (see FIG. 2) and is movable on the rails 5*d*, and the carriage that moves backward and forward 5 is supported by running wheels 5*b*, axles 5*a*, and bearings 5*c*.

The measuring frame 4 is supported by a load cell 4*a* that is fixed onto the carriage that moves backward and forward 5, with a rubber buffer 4*b* inserted intermediately. The first tilting frame 2 is supported by the first axis for tilting 2*a* and disposed above the measuring frame 4. A first tilting arm gear 2*c* is fixed to the end of the first axis for tilting 2*a* and is engaged with a first tilting pinion gear 2*d* that is fixed to an axle of a first servomotor for tilting the melting furnace 2*b*. Thus when the first servomotor for tilting the melting furnace 2*b* is driven, the first tilting frame 2 tilts in a corresponding movement.

The second axis for tilting 3*a* is fixed to one end of the upper part of the first tilting frame 2 and a second servomotor for tilting the melting furnace 3*b* is fixed to the other end. A second tilting pinion gear 3*d* is fixed to the axle of the second servomotor for tilting the melting furnace 3*b*. The second tilting frame 3 is supported by the second axis for tilting 3*a* and tiltable around the second axis for tilting 3*a*. Further, a second tilting sector gear 3*c* is fixed to the second tilting frame 3, which can be tilted by the second servomotor for tilting the melting furnace 3*b* via the second tilting sector gear 3*c* that is engaged with the second tilting pinion gear 3*d*.

Figure 4:
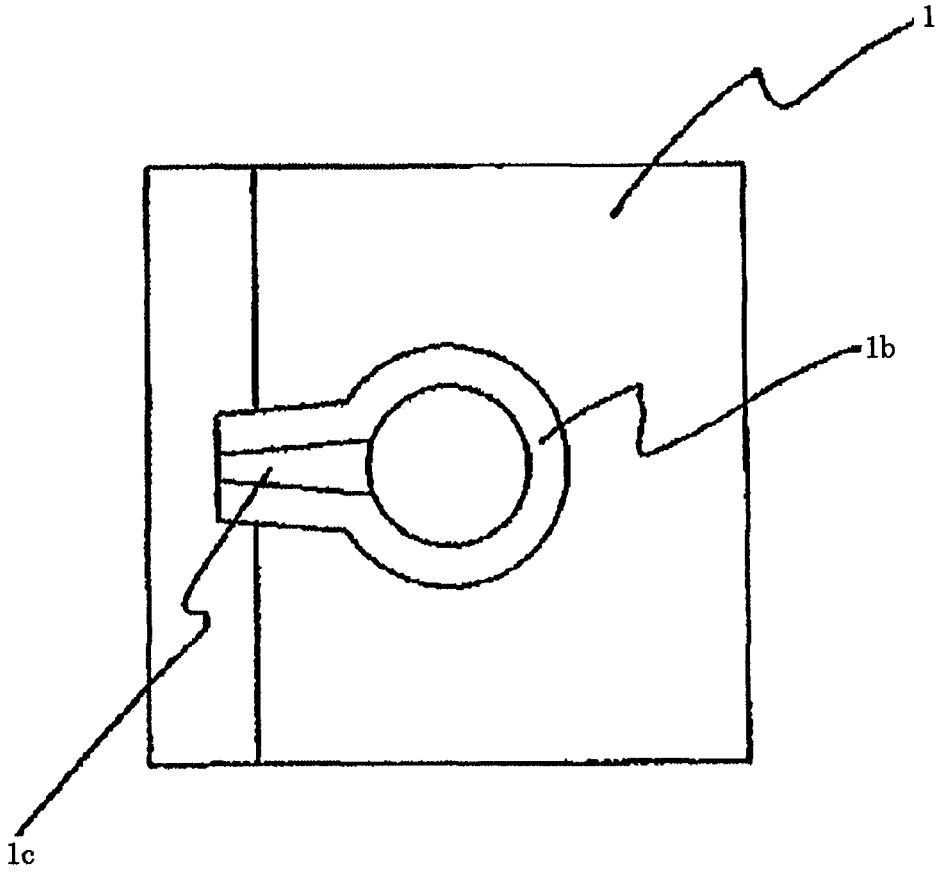
FIG. 4 is a schematic plan view of the melting furnace that is used for the pouring equipment having the melting furnace in the first embodiment of the present invention.

FIG. 4 is a schematic plan view of the melting furnace 1 that is used for the present invention. The melting furnace 1 has a furnace body 1*a* (see FIG. 5). An upper furnace body 1*b* that has the outflow portion 1*c* formed at the upper furnace body 1*b* is attached to the upper part of the furnace body 1*a*. The upper furnace body 1*b* is disposed nearly at the center of the melting furnace 1 in FIG. 4, which shows the schematic plan view of the melting furnace.

Figure 5:
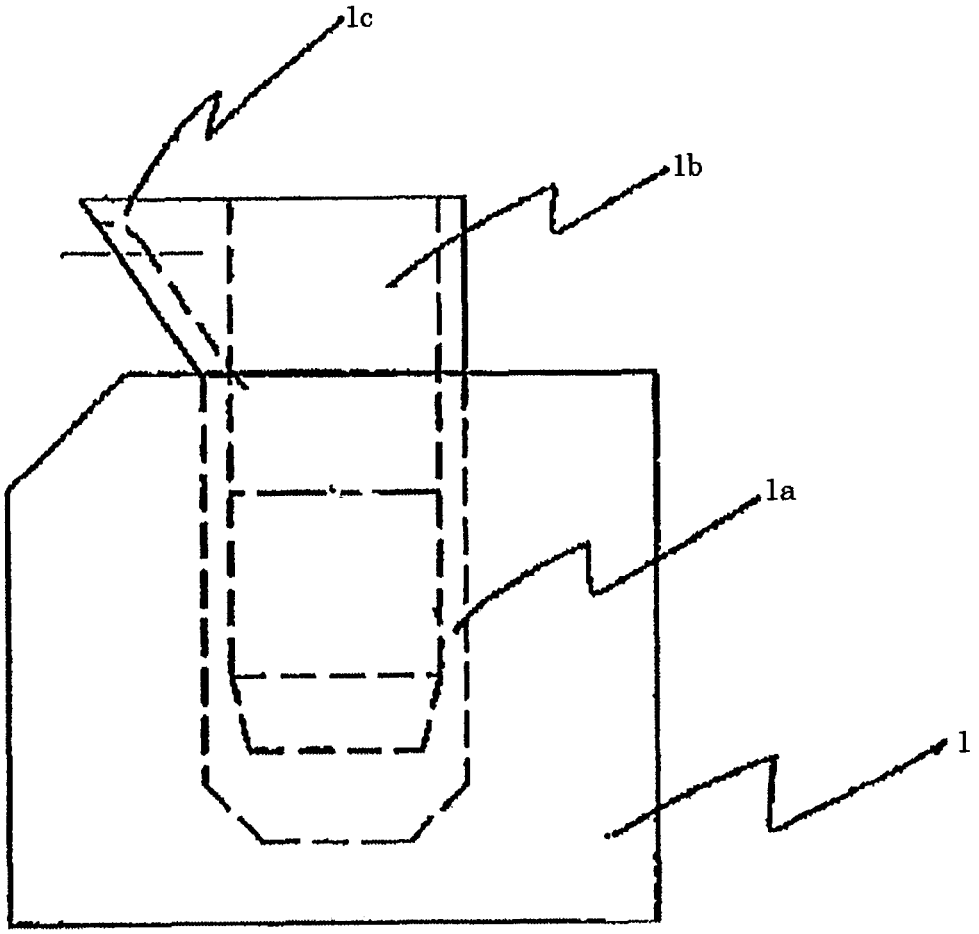
FIG. 5 is a schematic side view of the melting furnace that is used for the pouring equipment having the melting furnace in the first embodiment of the present invention.

FIG. 5 is a schematic side view of the melting furnace of the present invention. The melting furnace 1 has the furnace body 1*a* in the melting furnace 1 and a coil (not shown) is installed in the outer periphery of the furnace body 1*a* where material in the furnace body 1*a* can be melted by the coil.

Figure 6:
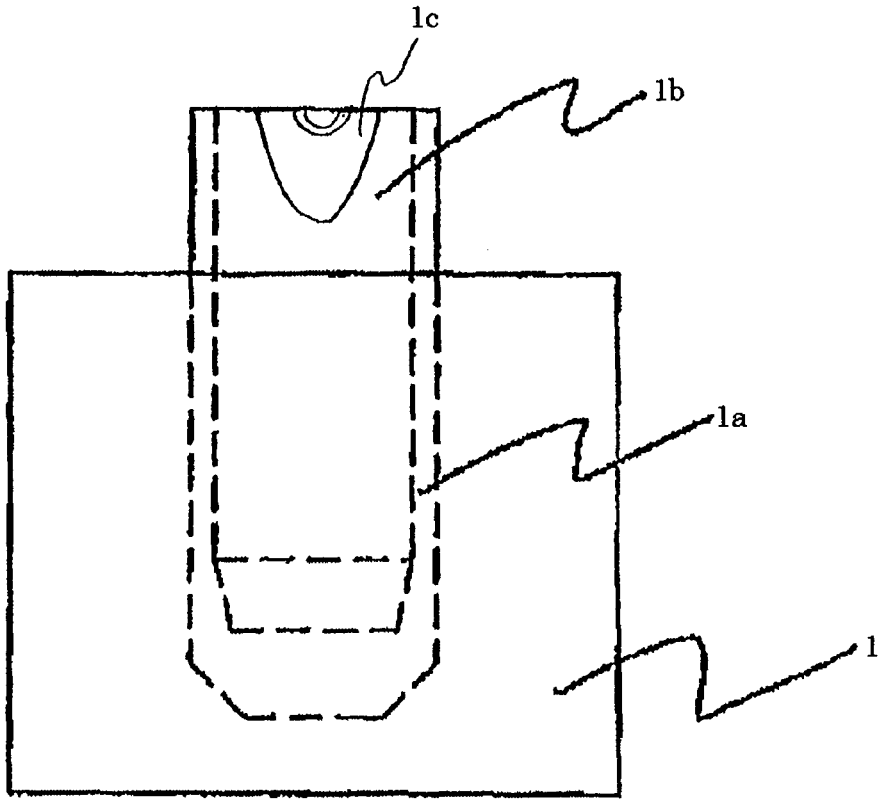
FIG. 6 is a schematic front view of the melting furnace that is used for the pouring equipment having the melting furnace in the first embodiment of the present invention.

FIG. 6 is a schematic front view of the melting furnace that is used for the present invention.

Figure 7:
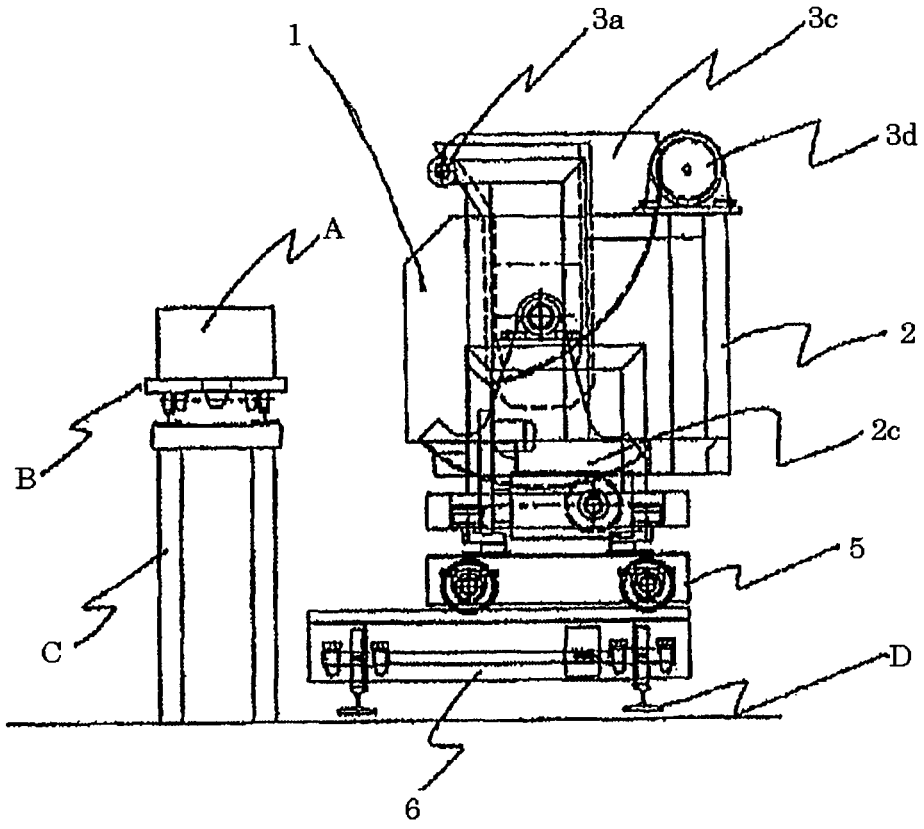
FIG. 7 is a side view of the melting furnace at the position when the pouring equipment having the melting furnace is in the melting process.

FIG. 7 shows the pouring equipment having the melting furnace where it is in the melting process. The melting furnace 1 is in a horizontal position and the melting furnace 1 receives the material and carries out the melting in this position. When the melting furnace 1 is in the horizontal position, the side wall of the furnace body 1*a* of the melting furnace 1 is in an upright position.

Figure 8:
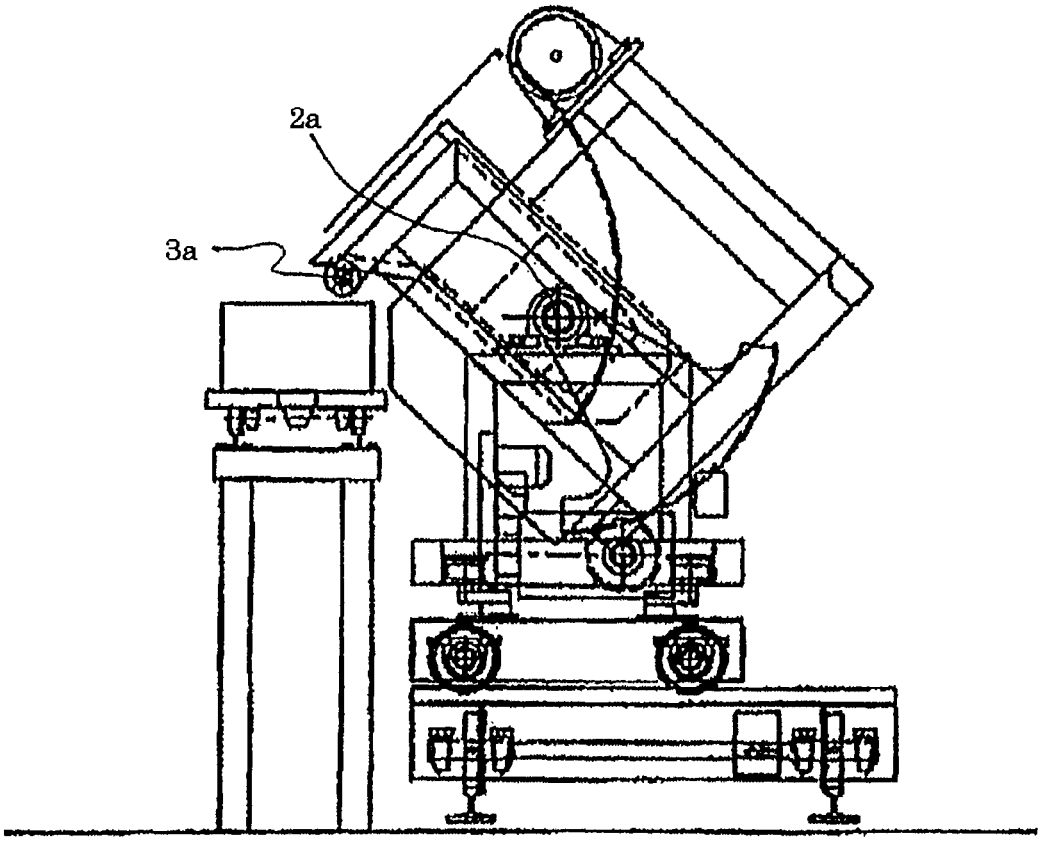
FIG. 8 is a side view of the melting furnace of the pouring equipment having the melting furnace where the melting furnace is tilted when it starts pouring the molten metal in the mold.

FIG. 8 shows the pouring equipment where it is about to pour into the mold A the molten material that the present equipment has melted. More specifically, the melting furnace 1 is tilted to the position around the first axis for tilting 2*a* driven by a first servomotor for tilting the melting furnace 2*b* via a first tilting arm gear 2*c* and a first tilting pinion gear 2*d*, so that the molten metal in the furnace body 1*a* is about to flow from the outflow portion 1*c* of the upper furnace body 1*b*.

Figure 9:
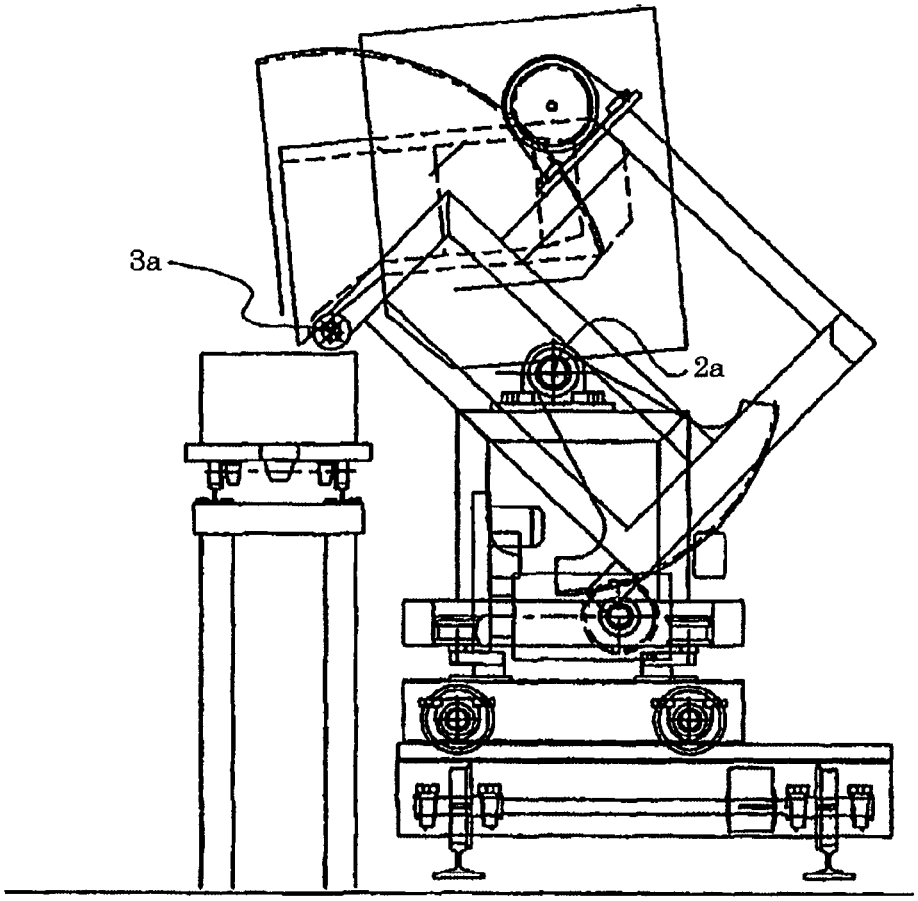
FIG. 9 is a side view of the melting furnace of the pouring equipment having the melting furnace, which melting furnace is tilted when it has completed pouring the molten metal in the mold.

FIG. 9 shows the pouring equipment whose melting furnace has completed pouring the molten metal in the mold. More specifically, it shows the pouring equipment where the melting furnace 1 is tilted above 90 degrees around the second axis for tilting 3*a* to have nearly the molten metal in the furnace body 1*a* poured out from the outflow portion 1*c* of the upper furnace body 1*b*. The melting furnace 1 can be tilted above 90 degrees around the second axis for tilting 3*a* by the second servomotor for tilting the melting furnace 3*b* via a second tilting sector gear 3*c* and a second tilting pinion gear 3*d*.

Next, the movement of the pouring equipment thus constituted that also works as a melting furnace is explained. As shown in FIG. 7, the pouring equipment that also works as the melting furnace is disposed so that it can run on the rails D that are laid parallel to the casting line A. Material for melting is supplied into the furnace body 1*a* which is in a horizontal position, by an apparatus for supplying material (not shown), where the material is melted by having the coil for melting energized. When the melting of the material is complete, then, as is shown in FIG. 8 the melting furnace 1 is moved closer to the mold A by means of the carriage that moves backward and forward 5. The melting furnace 1, after it has moved closer to the mold A, is tilted further around the first axis for tilting 2*a* just before the molten metal is about to flow from the outflow portion 1*c*. The melting furnace 1, after it has tilted around the first axis for tilting 2*a*, then tilts subsequently around the second axis for tilting 3*a* and pours the molten metal in the furnace body 1*a* into a sprue of the mold A.

The control for pouring the molten metal is carried out by controlling the weight of the molten metal whereby the total weight of the melting furnace 1 and that of the molten metal is measured by the load cell 4*a* (see FIG. 3) and then the weight of the molten metal that has poured out is calculated. Now the control for the tilting of the melting furnace 1 is explained in detail. The pouring equipment in the present embodiment comprises a device for control that controls the operation of the second servomotor for tilting the melting furnace 3*b*. The device for control comprises a section for calculating the flow of the molten metal, which section calculates the flow of the molten metal based on the results obtained from the load cell 4*a*, a section for accumulating the poured molten metal, which section accumulates the molten metal that is poured into the mold, based on the flow of the molten metal, and a section for controlling the tilting, which section instructs the melting furnace 1 to turn backward and stop pouring (i.e., the second servomotor for tilting the melting furnace 3*b* is turned backward) when the accumulated molten metal that is poured reaches the predetermined quantity, which occurs while the angle for tilting the melting furnace 1 is controlled based on the flow of the molten metal that is calculated by the section for calculating the flow of the molten metal. Thus when the weight of the molten metal that is poured into the mold reaches the weight of the molten metal that is scheduled for the mold, the melting furnace 1 is turned backward and the pouring stops. Then the pouring is complete. The device for control can also be arranged so that the section for controlling the tilting can adjust the angle of tilting the melting furnace 1 so as to have the flow of the molten metal correspond to the pouring pattern of the cast product.

The pouring is repeated until the molten metal in the furnace body 1*a* is exhausted. When the molten metal in the furnace body 1*a* is all poured out, the pouring process is complete and the melting furnace 1 is tilted back to the horizontal position. Then a melting process starts after the carriage that moves backward and forward 5 returns to the position as shown in FIG. 7.

In the present embodiment the tilting is carried out around the two axes for tilting. But the melting furnace 1 is not limited to one that turns around the two axes for tilting in so far as the melting furnace 1 can tilt.

Figure 10:
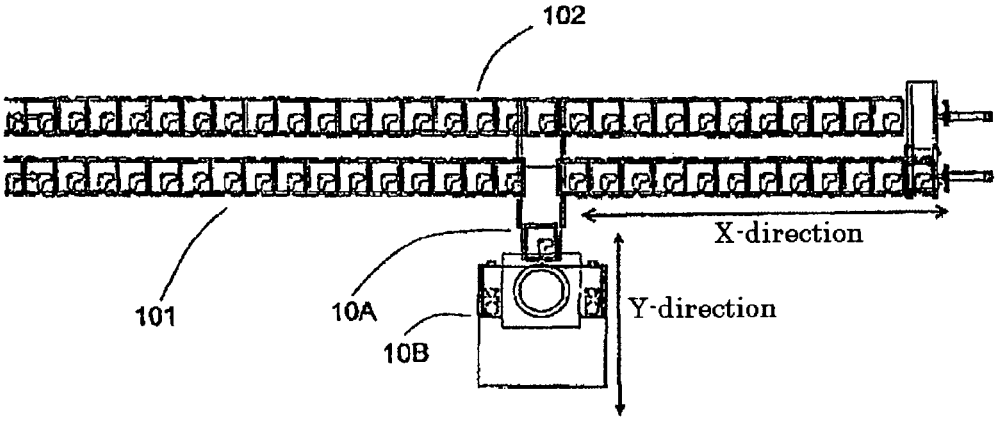
FIG. 10 is a plan view of the pouring equipment in the second embodiment of the present invention.

Next, the pouring equipment in the second embodiment of the present invention is explained. As shown in FIG. 10, the pouring equipment in the second embodiment comprises the control apparatus for controlling the position of the mold 10 A that is disposed perpendicularly to a line for transporting molds 101 and a melting furnace 10B that produces molten metal and that is disposed opposite the control apparatus for controlling the position of the mold 10 A. In the present embodiment a roller conveyor is used as the line for transporting molds 101 where the molds that are manufactured by the molding machine are transported continuously by a pusher cylinder (not shown) from left to right in FIG. 10. The mold that has completed the pouring of the molten metal is transferred to a line for carrying out the molds 102 by a traverser disposed at the end of the line for transporting molds 101 and transported to a next process.

Figure 11:
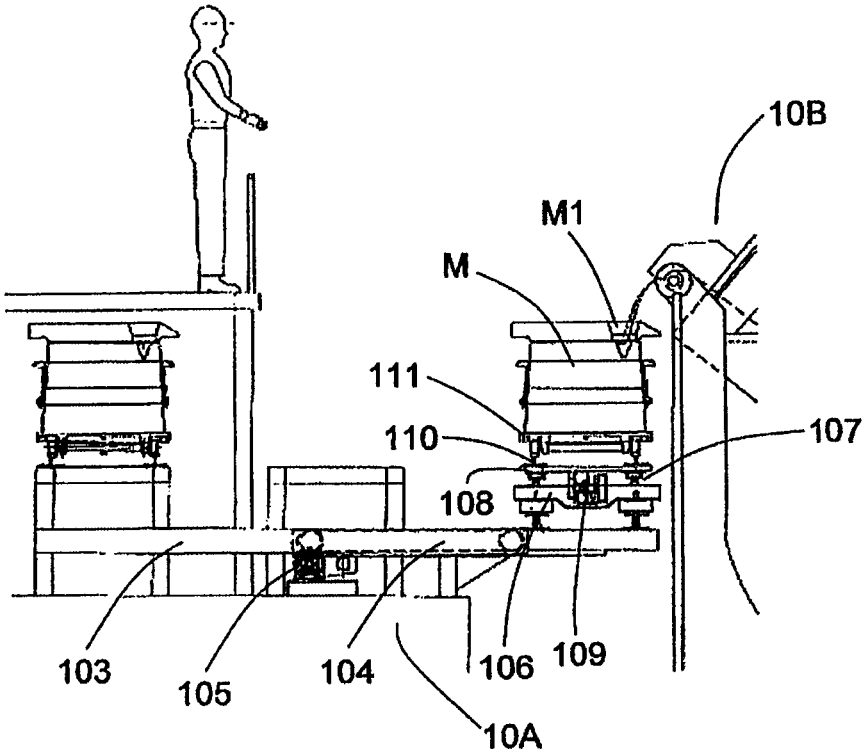
FIG. 11 is a detailed cross-sectional side view of the control apparatus for controlling the position of the mold of the present invention.

As shown in FIG. 11, the control apparatus for controlling the position of the mold 10 A comprises the following:

- a frame 103 that is fixed below the line for transporting molds 101;
- a carriage for transferring backward and forward 104 that can run on the frame 103 in the direction (hereafter, Y-direction) that is perpendicular to the direction of the transport of the molds M;
- an apparatus for driving backward and forward 105 that drives the carriage for transferring backward and forward 104;
- a measuring frame 106 that is fixed onto the carriage for transferring backward and forward 104 and that has a load cell;
- a carriage for transferring to the left and the right directions 108 that can run on rails 107 that are on the frame for measuring 106 in the direction (hereafter, X-direction) that is parallel to the direction of transport of the mold M; and
- an apparatus for driving in a traverse direction 109 that drives the carriage for transferring to the left and the right directions 108. The carriage for transferring to the left and the right directions 108 has rails for the transport of the molds 110, on which rails the molds M are placed via a surface plate 111.

Figure 12:
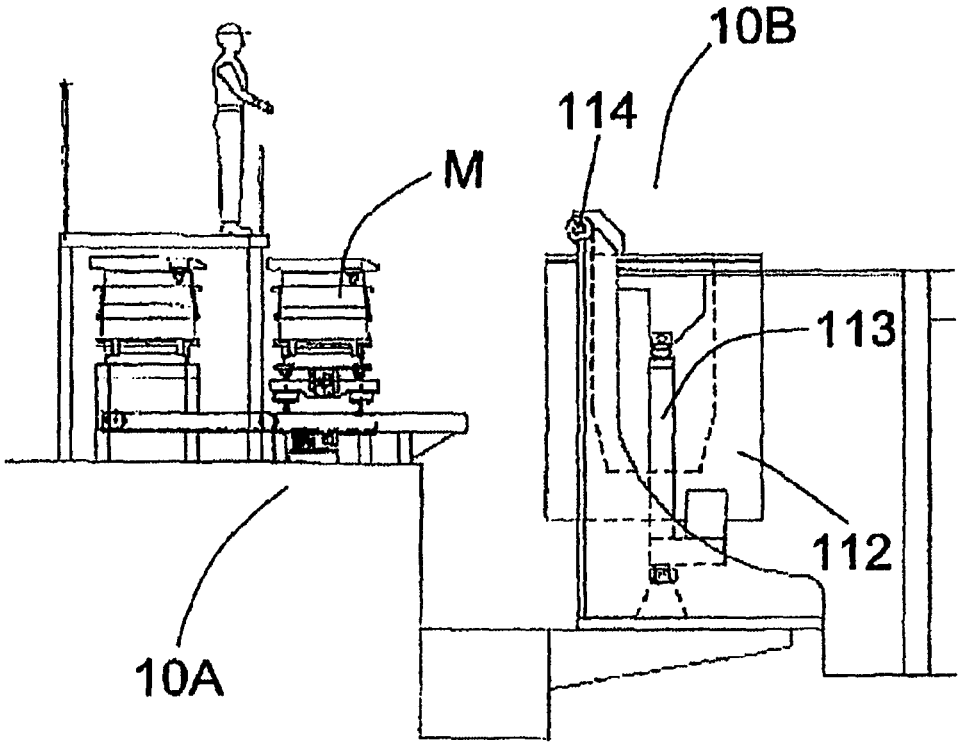
FIG. 12 is a cross-sectional side view of the pouring equipment in the second embodiment of the present invention.
Figure 13:
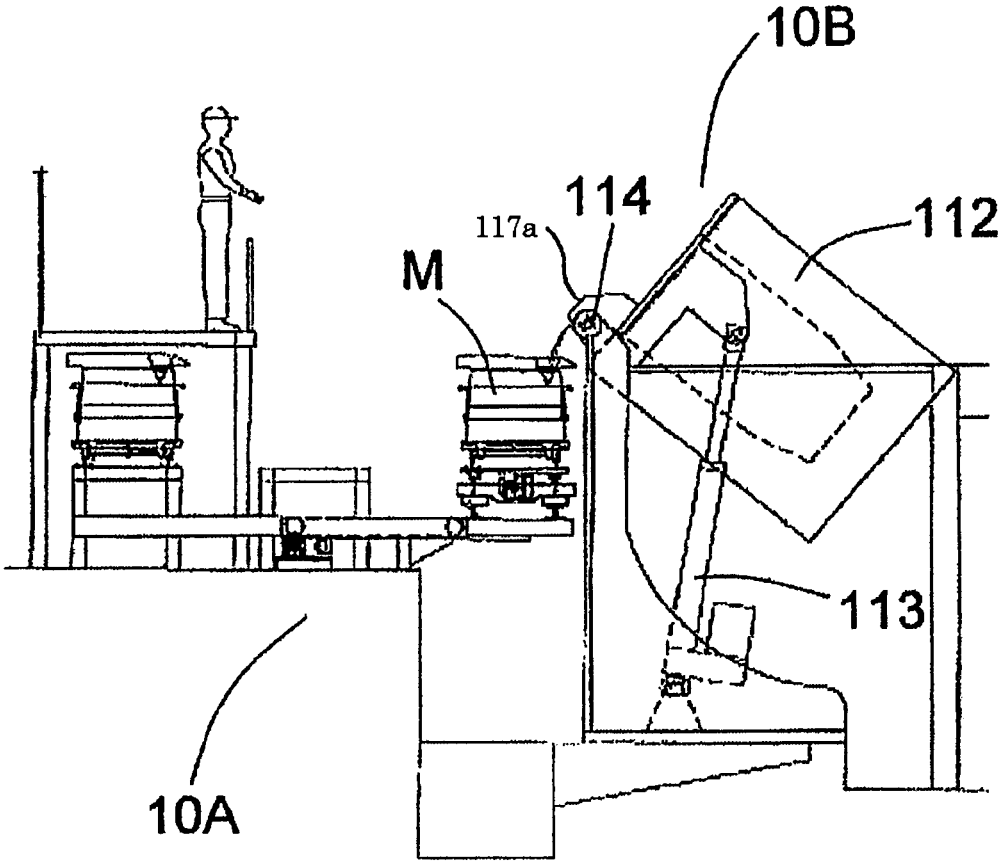
FIG. 13 is a cross-sectional side view of the pouring equipment in the second embodiment of the present invention.

The control apparatus for controlling the position of the mold 10 A thus constituted first transfers, by the carriage for transferring backward and forward 104, the mold M to the position before the melting furnace 10B that is opposite the control apparatus for controlling the position of the mold 10 A while the mold M is transported by the line for transporting molds 101. FIG. 12 shows the mold before it is transferred to the position before the melting furnace 10B. FIG. 13 shows the mold after it is transferred to the position before the melting furnace 10B. Then the mold M that is transferred to the position before the melting furnace 103 is moved in the X-direction by the carriage for transferring to the left and the right directions 108 so that the position of the sprue M1 of the mold M can match the position of the outflow portion of the melting furnace 10B. In the present embodiment the distance of the movement of the mold by the carriage for transferring backward and forward 104 in the Y-direction and the distance of the movement by the carriage for transferring to the left and the right directions 108 in the X-direction are determined based on the data on the mold (the data on the position of the sprue in this embodiment) sent from the line for transporting molds 101.

Also, the control apparatus for controlling the position of the mold 10 A may comprise a mechanism that can move up and down the carriage for transferring to the left and the right directions 108 up and down. Such mechanism can be any mechanism so long as it can move the carriage for transferring to the left and the right directions 108 up and down. For example a lifter of a pantograph-type can be provided below the frame 103 (the frame 103 is fixed to the lifter in this case). Here the movement of the mold in the up-and-down direction can be determined, as in the movements in the X- and Y-directions, based on the data on the mold, which data are sent from the line for transporting molds 101. The data on the mold in this case include those relating to the height of the mold.

In the present embodiment a load cell is used to measure the weight of the molten metal that was poured from the melting furnace into the mold. By using the load cell that measures the amount of the molten metal that was poured into the mold, the pouring of the molten metal from the melting furnace into the mold can be controlled. In this case the data on the mold includes the weight of the molten metal that is to be poured. The control of the amount of the molten metal that is to be poured can be carried out as in the first embodiment.

Next, the melting furnace 10B of the present embodiment is explained. As shown in FIGS. 12 and 13, the melting furnace 10B comprises a tilting cylinder 113 and a axis for tilting 114. The melting furnace 10B is tilted around the axis for tilting 114 by the tilting cylinder 113 being extended and pours the molten metal into the mold M. As shown in FIG. 10, the melting furnace 10B is disposed at a position that is opposite the position of the control apparatus for controlling the position of the mold 10 A. The position is fixed relative to the position of the control apparatus for controlling the position of the mold 10 A. So, no mechanism to move the melting furnace 10B relative to the mold is required.

As explained in the second embodiment of the present invention, by moving the mold relative to the pouring machine the position of the sprue can match the position of the outflow portion such that the pouring machine need not be moved. So, the pouring machine can be compact. Also, as the pouring machine need not be moved, the molten metal in the ladle does not undulate. Nor is the surface of the ladle eroded. So, the ladle can have a longer life.

Figure 14:
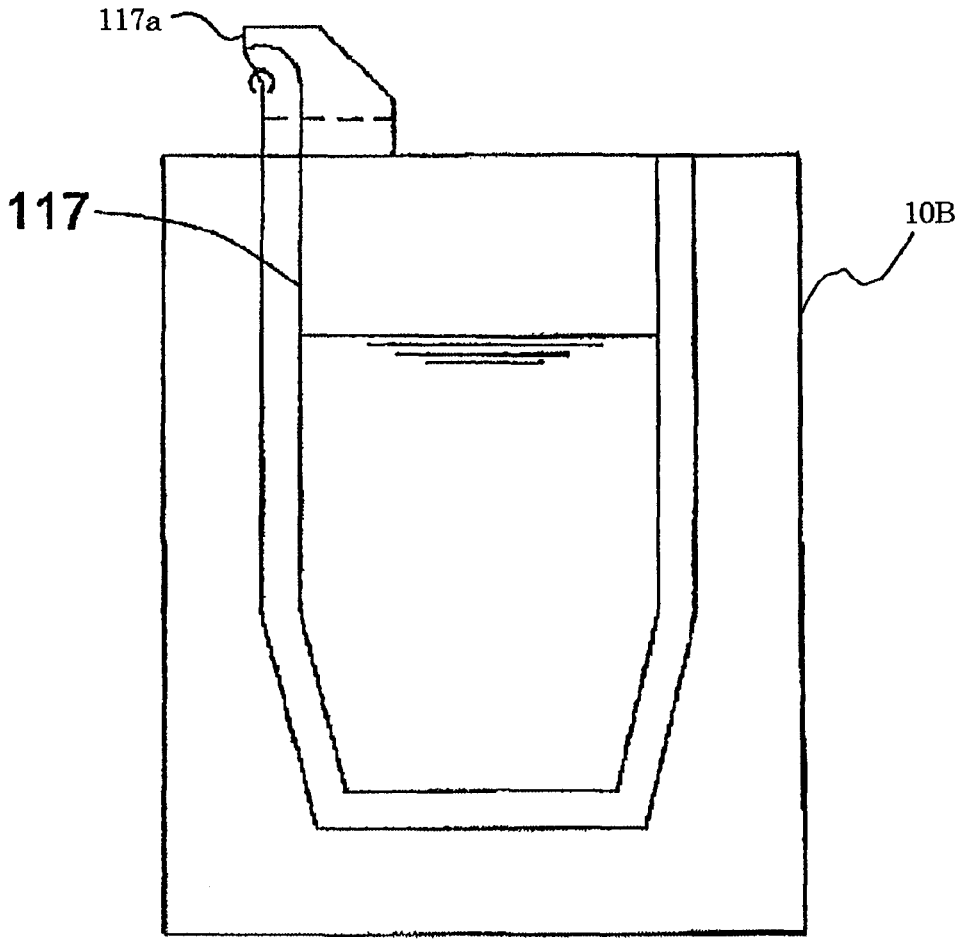
FIG. 14 is a cross-sectional side view of the melting furnace.
Figure 15:
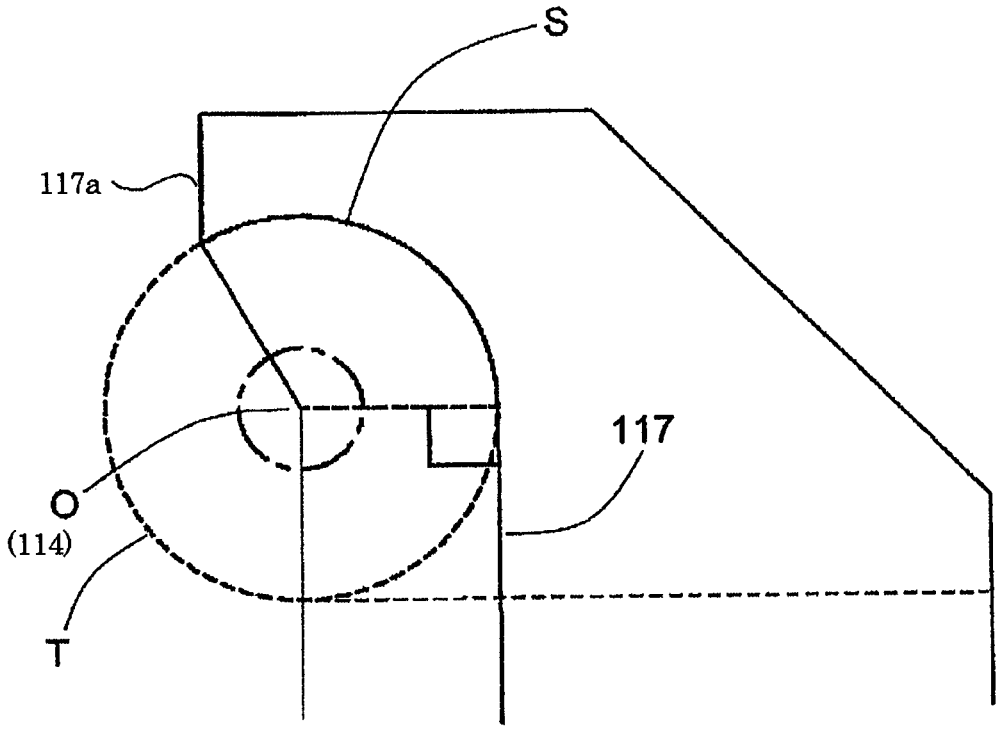
FIG. 15 is an enlarged view of a part of the melting furnace of FIG. 14.
Figure 16:
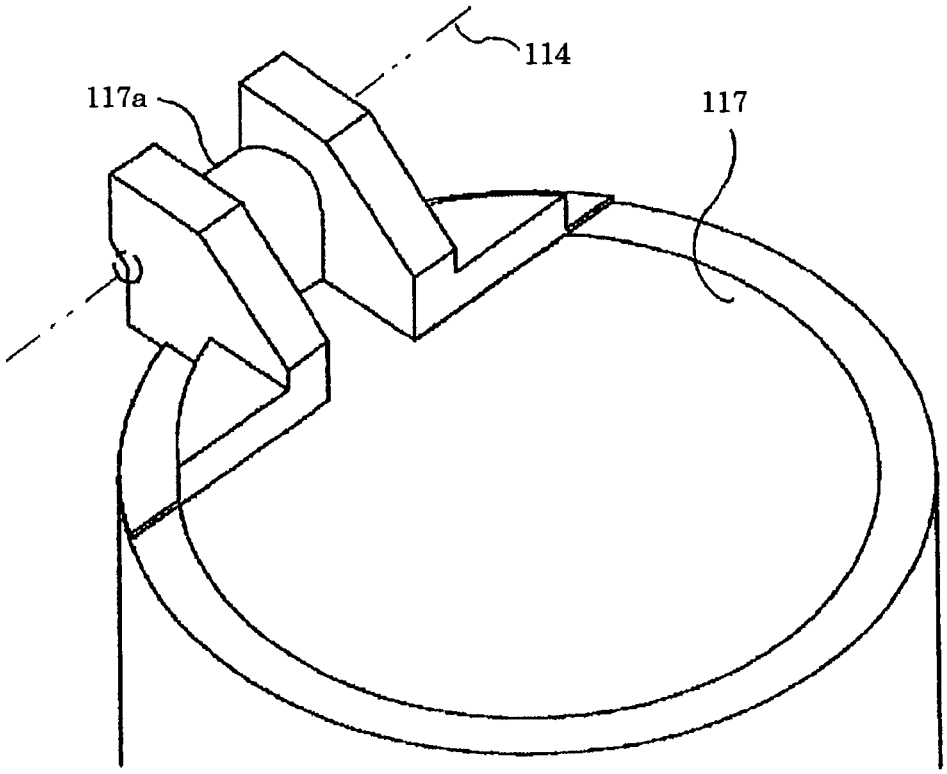
FIG. 16 is a perspective view of the shape of the outflow portion of the melting furnace of the present invention.

Next, the outflow portion 117*a* of the melting furnace 10B is explained. FIG. 14 shows the cross-sectional side view of the end-part of the outflow portion 117*a* of the melting furnace 10B. FIG. 15 is an enlarged view of a part of the outflow portion 117*a*. FIG. 16 shows a perspective view of the outflow portion 117*a* of the present invention. As shown in FIGS. 14 and 15, the outflow portion 117*a* of the melting furnace 10B of the present embodiment has a circular arc in its cross-sectional side view. Also, the melting furnace 10B tilts around the center of the circle that comprises the circular arc.

The movement of the melting furnace 10B is explained in detail based on FIG. 15. The cross-sectional side view of the end-part of the outflow portion 117*a* forms a circular arc S (solid line). The melting furnace 10B tilts around the axis that is the center of the circle T (dotted line) that comprises the circular arc S. Namely, the central axis for tilting 114 (see FIG. 16) pierces through the center of the circle T. More specifically, the circular arc S has a circumference whose convexity would be formed upward if the wall of the melting furnace 117 were vertically extended upward.

Also, the circle arc S forms a smooth line that is shared by the wall of the melting furnace 117. When the molten metal is poured, it flows along the circular arc S and then it leaves the circular arc S at a certain point.

In the present embodiment the melting furnace 10B tilts around the axis for tilting 114, which axis pierces through the center O of the circle 1, a part of which forms the circular arc S. For this reason the point where the molten metal leaves the circular arc S is nearly constant in the vertical and horizontal directions irrespective of the angle of the tilting of the melting furnace 10B. For this reason even though a melting furnace is used for pouring that has a larger size compared with a pouring ladle, thus making it hard to accurately pour the molten metal, it is possible to have a stable flow line of the molten metal and to attain accurate pouring.

As shown in FIG. 15, in the present embodiment, the wall 117 of the melting furnace 10B is formed so that it is tangent to the circle T. (That is, as shown in FIG. 15, the radius of the circle T and the wall 117 forms a right angle where the circle T and the wall 117 have a contact point.) In this way the flow line of the molten metal becomes more stable, and more accurate pouring can be carried out.

Figure 17:
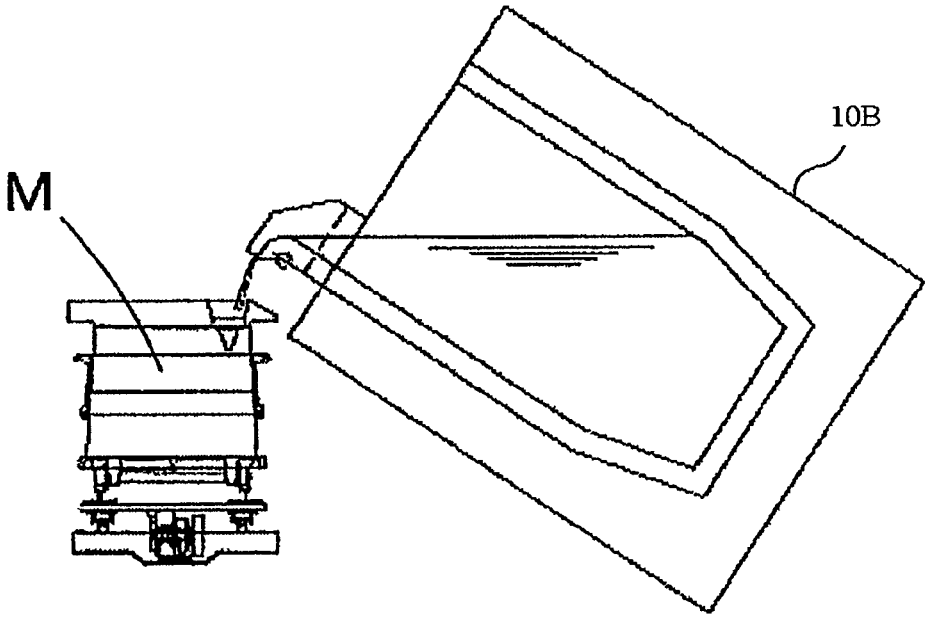
FIG. 17 is a cross-sectional side view showing the pouring by the pouring equipment of the present invention.
Figure 18:
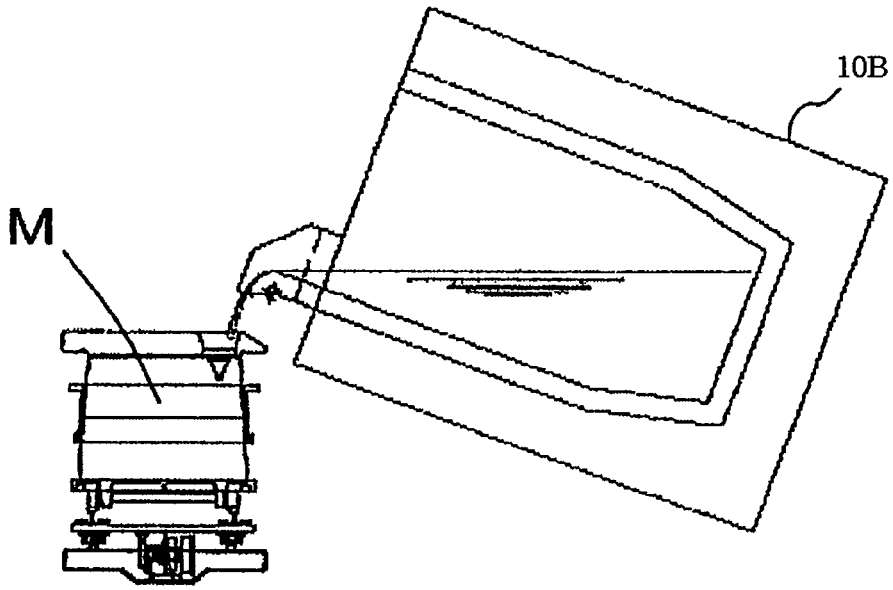
FIG. 18 is a cross-sectional side view showing the pouring by the pouring equipment of the present invention.
Figure 19:
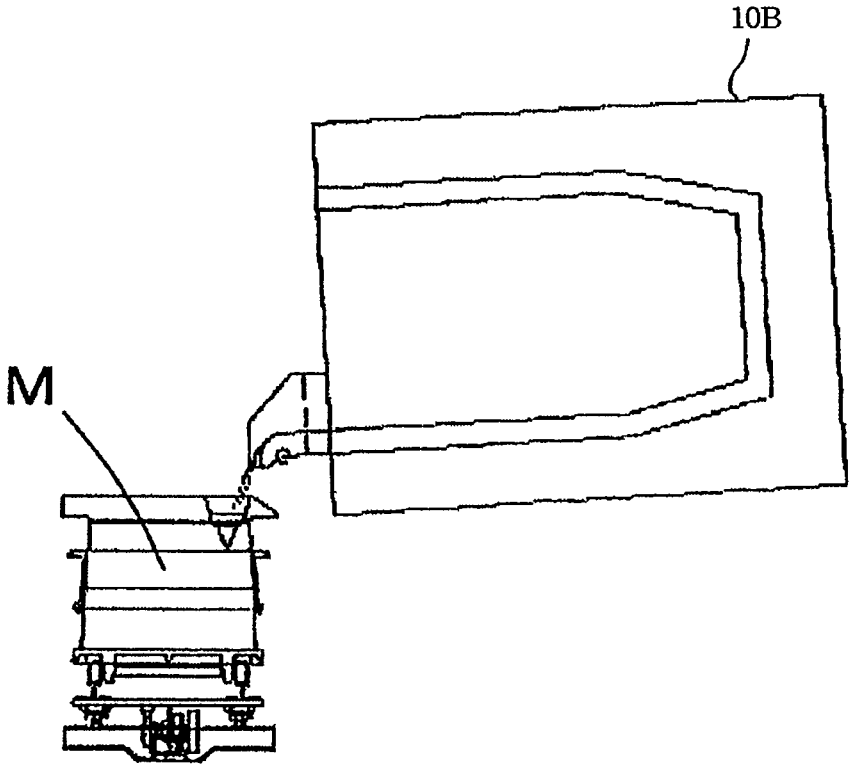
FIG. 19 is a cross-sectional side view showing the pouring by the pouring equipment of the present invention.

FIGS. 17-19 show the pouring by the melting furnace of the present embodiment. The molten metal is poured into the mold M by the melting furnace 106 being tilted. By having the cross-sectional side view of the end-part of the outflow portion made as a circular arc, by having the center of the circle that comprises the circular arc made as a center of tilting of the melting furnace, and also by having the well of the melting furnace forming the tangent of the circle, the flow line has become more stable and has enabled stable pouring.

The representative embodiments of the present invention are now explained. But the present invention is not limited to the embodiments hereinabove explained. One skilled in the art can modify the inventions of the claims without deviating from the scope of the present invention.

SYMBOLS

1 melting furnace
1*a* furnace body
1*b* upper furnace body
1*c* outflow portion
2 first tilting frame
2*a* first axis for tilting
2*b* first servomotor for tilting the melting furnace
2*c* first tilting arm gear
2*d* first tilting pinion gear
3 second tilting frame
3*a* second axis for tilting
3*b* second servomotor for tilting the melting furnace
3*c* second tilting sector gear
3*d* second tilting pinion gear
4*a* load cell
5 carriage that moves backward and forward
5*e* servomotor for driving backward and forward
6 carriage that moves in a traverse direction
6*d* servomotor for driving in a traverse direction
A mold
10A control apparatus for controlling the position of the mold
10B melting furnace
M mold
O center of circle
S circular arc
T circle that comprises a circular arc S
117 wall of melting furnace
117*a* outflow portion

The invention claimed is:

1. Pouring equipment that pours molten metal into a mold, comprising a melting furnace that produces molten metal by melting metal material and a driving apparatus that moves the melting furnace backward and forward and in a traverse direction, wherein the pouring equipment pours the molten metal directly into the mold from the melting furnace by tilting the melting furnace relative to the mold, wherein the melting furnace has an outflow portion located at an upper portion of the furnace, from which the molten metal is poured into the mold, where a cross-sectional side view of an end-part of the outflow portion has a circular arc, and where a center of a circle that comprises the circular arc is a center for tilting the melting furnace, wherein the cross-sectional side view of an inner wall of the melting furnace forms a tangent of the circle, and wherein the melting furnace tilts around two axes for tilting that are disposed between an upper end and a lower end of the melting furnace where a first axis extends perpendicularly to a direction of the tilting of the melting furnace and a second axis, which goes through the center of the circular arc that is formed by the cross-sectional side view of an end-part of the outflow portion and which extends parallel to the first axis, and wherein the pouring equipment pours the molten metal directly into the mold from the melting furnace where the melting furnace is tilted by being rotated around the first axis, thereby having the outflow portion come closer to the mold just before the start of the pouring and where the melting furnace is further tilted by being rotated around the second axis so as to pour the molten metal into the mold.

2. The pouring equipment of claim 1, comprising a servomotor for driving the driving apparatus, a driving apparatus for tilting that tilts the melting furnace, a load cell that measures the quantity of the molten metal that was poured from the melting furnace into the mold, and a control apparatus that controls, based on the quantity of the molten metal that was poured, a servomotor for tilting the melting furnace, wherein the pouring equipment automatically pours the molten metal into the mold under the control of the control apparatus.

3. Pouring equipment that pours molten metal into a mold, comprising a melting furnace that produces molten metal by melting metal material and a control apparatus for controlling the position of the mold, which apparatus moves the mold backward and forward and to the left and right relative to the melting furnace, wherein the pouring equipment that pours the molten metal directly into the mold from the melting furnace tilts the melting furnace relative to the mold, wherein the melting furnace has an outflow portion located at an upper portion of the furnace, from which the molten metal is poured into the mold, where a cross-sectional side view of an end-pad of the outflow portion has a circular arc, and where a center of a circle that comprises the circular arc is a center for tilting the melting furnace, wherein the cross-sectional side view of an inner wall of the melting furnace forms a tangent of the circle, and wherein the melting furnace tilts around two axes for tilting that are disposed between an upper end and a lower end of the melting furnace where a first axis extends perpendicularly to a direction of the tilting of the melting furnace and a second axis, which goes through the center of the circular arc that is formed by the cross-sectional side view of an end-part of the outflow portion and which extends parallel to the first axis, and wherein the pouring equipment pours the molten metal directly into the mold from the melting furnace where the melting furnace is tilted by being rotated around the first axis, thereby having the outflow portion come closer to the mold just before the start of the pouring and where the melting furnace is further tilted by being rotated around the second axis so to as to pour the molten metal into the mold.

4. The pouring equipment of claim 3, wherein the control apparatus for controlling the position of the mold moves the mold backward and forward, to the left and right, and up and down, relative to the melting furnace.

5. The pouring equipment of claim 3, comprising a load cell that is used to measure the weight of the mold to calculate the quantity of the molten metal that was poured from the melting furnace into the mold and a device for control that controls the tilting of the melting furnace based on the weight of the molten metal that was poured from the melting furnace into the mold.

* * * * *